US005295633A

United States Patent [19]

Kimbro et al.

[11] Patent Number: 5,295,633

[45] Date of Patent: Mar. 22, 1994

[54] DOCUMENT SHREDDING MACHINE WITH STRIPPER AND CUTTING MECHANISM THEREFORE

[75] Inventors: C. David Kimbro, Schaumburg; David E. May, Geneva, both of Ill.

[73] Assignee: Fellowes Manufacturing Company, Itasca, Ill.

[21] Appl. No.: 820,209

[22] Filed: Jan. 13, 1992

[51] Int. Cl.[5] ..... B02C 18/16

[52] U.S. Cl. ..... 241/166; 241/236

[58] Field of Search ..... 241/236, 166, 167, 295

[56] References Cited

U.S. PATENT DOCUMENTS

| | | | |
|---|---|---|---|
| 201,938 | 4/1878 | Nickerson | 241/295 |
| 1,019,828 | 3/1912 | O'Bryan . | |
| 1,090,914 | 3/1914 | Guettler . | |
| 1,178,386 | 4/1916 | Edwards . | |
| 1,673,336 | 6/1928 | Lehmicke . | |
| 1,699,157 | 1/1929 | Pendleton . | |
| 1,731,967 | 10/1929 | Antonsen . | |
| 2,182,219 | 12/1939 | Ashley . | |
| 2,202,843 | 6/1940 | Edwards . | |
| 2,216,612 | 10/1940 | Dimm et al. . | |
| 2,224,948 | 12/1940 | Bloomquist . | |
| 2,236,969 | 4/1941 | Flateboe . | |
| 2,381,775 | 8/1945 | Roddy . | |
| 2,554,114 | 5/1951 | Menkin et al. . | |
| 2,770,302 | 11/1956 | Lee . | |
| 2,873,923 | 2/1959 | Bergman . | |
| 2,894,697 | 7/1959 | Panning et al. . | |
| 3,033,064 | 5/1962 | Lee . | |
| 3,126,931 | 3/1964 | Blanshine et al. . | |
| 3,286,574 | 11/1966 | Durand . | |
| 3,396,914 | 8/1968 | Liebman . | |
| 3,510,077 | 5/1970 | Priscu . | |
| 3,524,597 | 8/1970 | Burden, Jr. et al. . | |
| 3,529,782 | 9/1970 | Liebman . | |
| 3,620,461 | 11/1971 | Pelleschi et al. . | |
| 3,620,462 | 11/1971 | Dooley, Jr. . | |
| 3,630,460 | 12/1971 | Goldhammer . | |
| 3,664,592 | 5/1972 | Schweigert et al. . | |
| 3,724,766 | 4/1973 | Bosland . | |
| 3,790,093 | 2/1974 | McIntyre . | |
| 3,797,765 | 3/1974 | Samuels . | |
| 3,860,180 | 1/1975 | Goldhammer | 241/27 |
| 3,894,697 | 7/1975 | Lawson et al. | 241/59 |
| 3,921,920 | 11/1975 | Brocard | 241/159 |
| 3,931,935 | 1/1976 | Holman | 241/24 |
| 3,960,334 | 6/1976 | Wudyka | 241/60 |
| 4,018,392 | 4/1977 | Wagner | 241/167 |
| 4,034,918 | 7/1977 | Culbertson et al. | 241/36 |
| 4,068,805 | 1/1978 | Oswald | 241/159 |
| 4,106,708 | 8/1978 | Kropa | 241/222 |
| 4,172,400 | 10/1979 | Brierley | 83/500 |
| 4,194,698 | 3/1980 | Kosmowski | 241/236 |
| 4,200,239 | 4/1980 | Simone et al. | 241/36 |
| 4,226,372 | 10/1980 | Wigand | 241/34 |
| 4,241,882 | 12/1980 | Baikoff | 241/236 |

(List continued on next page.)

FOREIGN PATENT DOCUMENTS

| | | | |
|---|---|---|---|
| 10681 | 5/1980 | European Pat. Off. . | |
| 0291774A3 | 11/1988 | European Pat. Off. . | |
| 441182 | 8/1991 | European Pat. Off. . | |
| 3001507 | 7/1981 | Fed. Rep. of Germany . | |
| 3239060 | 4/1984 | Fed. Rep. of Germany | 241/236 |
| 705066 | 3/1954 | United Kingdom . | |
| 1502076 | 2/1978 | United Kingdom . | |
| 1558423 | 1/1980 | United Kingdom | 241/236 |
| 1569375 | 6/1980 | United Kingdom . | |
| 1574027 | 9/1980 | United Kingdom | 241/236 |
| 2059804 | 4/1981 | United Kingdom | 241/167 |
| 2241906A | 9/1991 | United Kingdom . | |

*Primary Examiner*—Mark Rosenbaum

*Assistant Examiner*—John M. Husar

*Attorney, Agent, or Firm*—Wilian Brinks Hofer Gilson & Lione

[57] ABSTRACT

A paper shredder with a cutting mechanism and strippers that are formed on the bottom base of the shredder. The strippers have an arcuate shaped portion to substantially surround the space between adjacent cutting disks to prevent shredded paper from accumulating and clogging the cutting mechanism. The paper shredder has cutting disks with teeth that include a piercing tooth and a flat tooth.

13 Claims, 5 Drawing Sheets

U.S. PATENT DOCUMENTS 4,257,565 3/1981 Hatanaka ..... 241/100
4,260,115 4/1981 Hatanaka ..... 241/236
4,330,092 5/1982 Roman ..... 241/236
4,334,650 6/1982 Hardwick et al. .
4,346,851 8/1982 Bernardi et al. .
4,349,159 9/1982 Hardwick et al. .
4,351,485 9/1982 Hardwick et al. .
4,355,766 10/1982 Wigand .
4,363,453 12/1982 Hill et al. .
4,385,732 5/1983 Williams .
4,411,391 10/1983 Crane .
4,426,044 1/1984 Butler .
4,489,897 12/1984 Turner et al. .
4,522,096 6/1985 Niven, Jr. .
4,545,537 10/1985 Kimura et al. .
4,557,421 12/1985 Probst et al. .
4,558,827 12/1985 Berger .
4,562,971 1/1986 Schwelling .
4,564,146 1/1986 Bleasdale .
4,565,330 1/1986 Katoh .
4,615,490 10/1986 Goldhammer .
4,619,407 10/1986 Goldhammer .
4,625,925 12/1986 Goldhammer .
4,627,581 12/1986 Holiman et al. .
4,627,582 12/1986 Goldhammer .
4,637,560 1/1987 Goldhammer .
4,657,192 4/1987 Browning .
4,688,730 8/1987 Dahle .
4,690,340 9/1987 Hatanaka .
4,691,871 9/1987 Mochizuki .
4,693,428 9/1987 Raterman et al. .
4,702,422 10/1987 Chambers, Sr. et al. ..... 241/46.06
4,717,085 1/1988 Crane .
4,860,963 8/1989 Goldhammer et al. .
4,881,692 11/1989 Goldhammer et al. .
4,889,291 12/1989 Goldhammer et al. .
4,944,462 7/1990 Raterman et al. ..... 241/100
5,071,080 12/1991 Herbst et al. ..... 241/166
5,141,168 8/1992 Pepper ..... 241/236

DOCUMENT SHREDDING MACHINE WITH STRIPPER AND CUTTING MECHANISM THEREFORE

BACKGROUND OF THE INVENTION

This invention relates to a compact, easy to assemble, low cost paper shredder.

Generally, there are two types of cutting mechanisms, "straight cut" or "strip" and "cross cut." A straight cut mechanism comprises a pair of parallel cutting cylinders that contain a series of spaced apart circular cutting disks arranged along the axis of the cylinder. The cutting disks on one cylinder are interleaved with the cutting disks on the other cylinder. The individual cutting disks typically are roughed about the periphery or have a large number of small teeth placed about the periphery of the disk.

The problem with these types of cutters is that the paper is shredded into narrow strips typically as long as the sheet of paper which has just been shredded. Thus, it is possible to reassemble the strips so that the original document can be reproduced.

In contrast, a cross cut type mechanism cuts the paper into small chips or very small strips. Thus, it is sometimes preferable to use a cross cut shredder to maximize the destruction of the paper and to minimize the volume of the waste material.

A cross cut cutting mechanism also comprises a pair of parallel cutting cylinders that contain a series of spaced apart cutting disks arranged along the axis of the cylinder. Each of the cutting disks, however, have less teeth placed about the periphery of the disk compared to the number of teeth on the disks of a straight cut type mechanism. For example, U.S. Pat. No. 4,860,963 shows a cross cut type cutting mechanism where each cutting disk has between 12 and 24 teeth. It also shows that the teeth on one cylinder inter-mesh and overlap with the teeth on the other cylinder.

A particular problem with cross cut mechanisms is the strain on the motor when the teeth engage the paper as a result of the resistance of the paper to being cut. Thus, it has been suggested to displace adjacent cutting disks or their teeth from one another to form a large pitch helix to lessen the cyclical strain on the motor. Also, if the tooth tip is shaped in the form of a V-notch, the tips tend to wear easily and can fracture when encountering a foreign object such as a paper clip.

Moreover, the problem with both of these types of cutting mechanisms is that after the paper has been shredded, it tends to accumulate in the cutting mechanism and, if not prevented, eventually cause the mechanism to be jammed. Particularly in the straight cut mechanism, after the paper has been cut into strips, the strips tend to wind around the cutting disks and spacers, clogging the cutting mechanism. In cross cut mechanisms, the shredded chips tend to follow the direction of the cutting cylinders and eventually clog the cutting mechanism.

To solve this problem it has been suggested to provide a stripping means to strip away the cut paper. Typically, the stripping means consist of a serrated member or a comb type member having teeth which protrude in the spaces between the individual cutting disks. These members can be located on the outward or post-shredder side of the cutting mechanism. For example, U.S. Pat. No. 4,068,805 shows a comb means rigidly placed at the exit of the cutting mechanism.

Another method of providing a stripping means in shown in U.S. Pat. No. 3,033,064 which discloses a pair of combs each having a series of spaced teeth that project into the spaces between each cutting disk to remove the cut strips of paper. Each comb is rigidly mounted so that the teeth protrude into the side of the cutter shaft opposite the cutting area of the cutting mechanism. In addition, they are circular shape so that they wrap around the series of cutting disks.

In addition, it has been suggested to provide a comb type member before the cutting mechanism. The comb then guides the uncut paper into the cutting mechanism. U.S. Pat. No. 4,018,392 shows a pair of combers attached to support rods, each comber having a tongue protruding forward of the cutting mechanism to comb and direct the material being fed to the cutting surfaces of the cutting mechanism.

The problem with these shredders and others is that a number of individual parts are required. Separate parts are required for the comb assembly and for mounting to the shredder housing. This increases the time and labor required to assemble the shredder which in turn increases the cost of the shredder. Therefore, the present invention is directed to a paper shredder that has few parts and is easy to assemble. The shredder includes sintered metal cutting disk units having teeth with a raked piercing tooth and a flat tooth. This will result in a paper shredder that has a lower cost than conventional paper shredders.

In addition, the present invention provides a stripper that effectively prevents the shredded chips from a cross cut mechanism from clogging the mechanism.

SUMMARY OF THE INVENTION

The invention provides a stripper for removing cut material from the cutting area of a paper shredder having either a straight cut or a cross cut type cutting mechanism. Generally, the paper shredder has a top housing, a bottom base, and a cutting mechanism comprising two parallel cutting cylinders each having a plurality of spaced apart cutting disks.

The stripper comprises a plurality of spaced apart first lower strippers integrally formed on and extending from a front wall on the bottom base. The top portion of each of the strippers are arcuately shaped to partially surround the space between the cutting disks on a first cutting cylinder.

In another embodiment, the stripper can comprise first lower strippers as well as a plurality of spaced apart second lower strippers integrally formed on and extending from a rear wall on the bottom base. The top portion of the second lower strippers are arcuately shaped to partially surround the space between the cutting disks on a second cutting cylinder.

In another embodiment, the stripper can comprise first upper strippers as well as first lower strippers. The first upper strippers are integrally formed on and extend from a front wall on the top housing. The bottom portion of the first upper strippers are arcuately shaped to partially surround the space between the cutting disks on the second cutting cylinder. When the top housing is joined to the bottom base, the first upper strippers substantially abut the first lower strippers to substantially surround the space between the cutting disks on the first cutting cylinder so that the shredded paper is effectively prevented from following the rotation of the cutting cylinder.

The invention further provides a cutting mechanism for a paper shredder. The cutting mechanism comprises two parallel cutting cylinders, each having a plurality of spaced apart cutting disks. The cutting disks of the first cutting cylinder are interleaved with the cutting disks of the second cutting cylinder. Also, each cutting disk has a plurality of disk teeth protruding outward and inclined forward in the rotation direction of the corresponding cutting cylinder. The teeth comprise a piercing tooth and a flat tooth.

DETAILED DESCRIPTION OF THE INVENTION AND PREFERRED EMBODIMENTS

Figure 1:
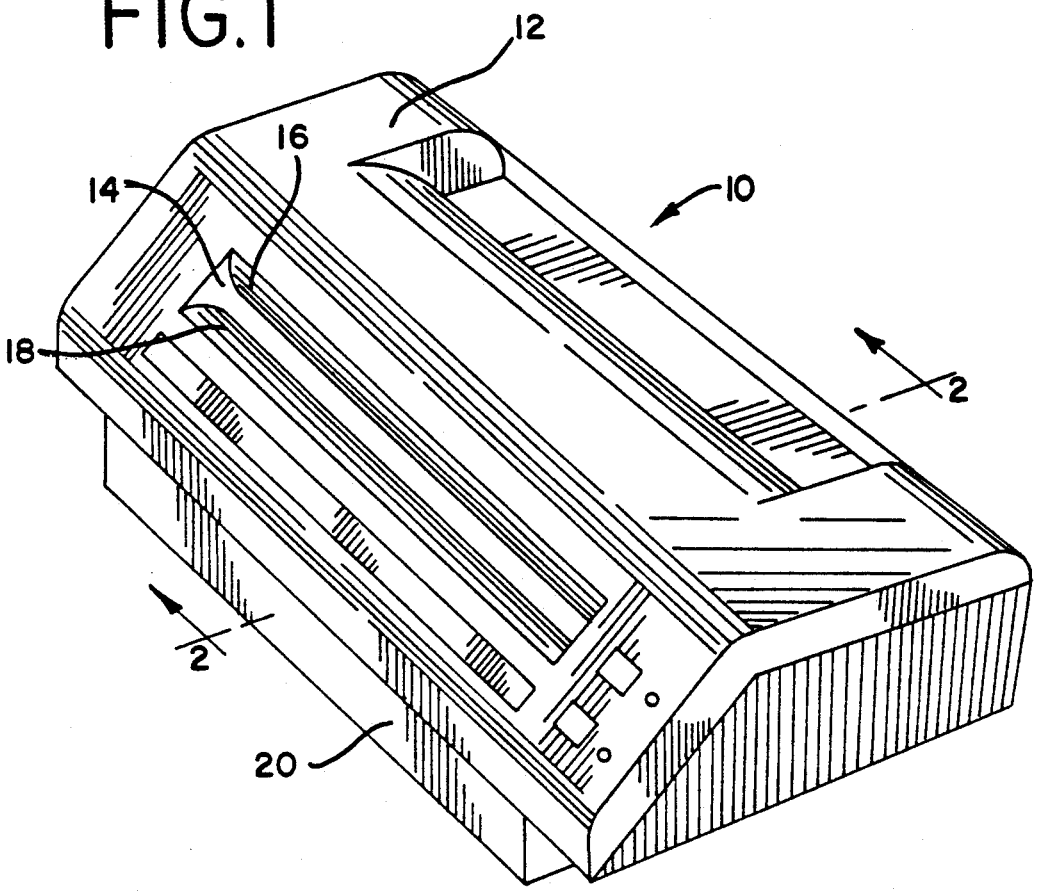
FIG. 1 is a perspective view of an assembled paper shredder.

FIG. 1 illustrates a paper shredding machine 10 having a cover 12 with a bottom base 20. Paper is fed into a cover feed opening 14 located on the top surface of the cover 12. The paper is guided to the cutting mechanism which comprises cutting cylinders 22 and 24, best seen in FIG. 2, by upper feed guide 16 and lower feed guide 18. After the paper is shredded by the action of the cutting cylinders 22, 24 it falls through the discharge opening 44 seen in FIG. 2.

Figure 2:
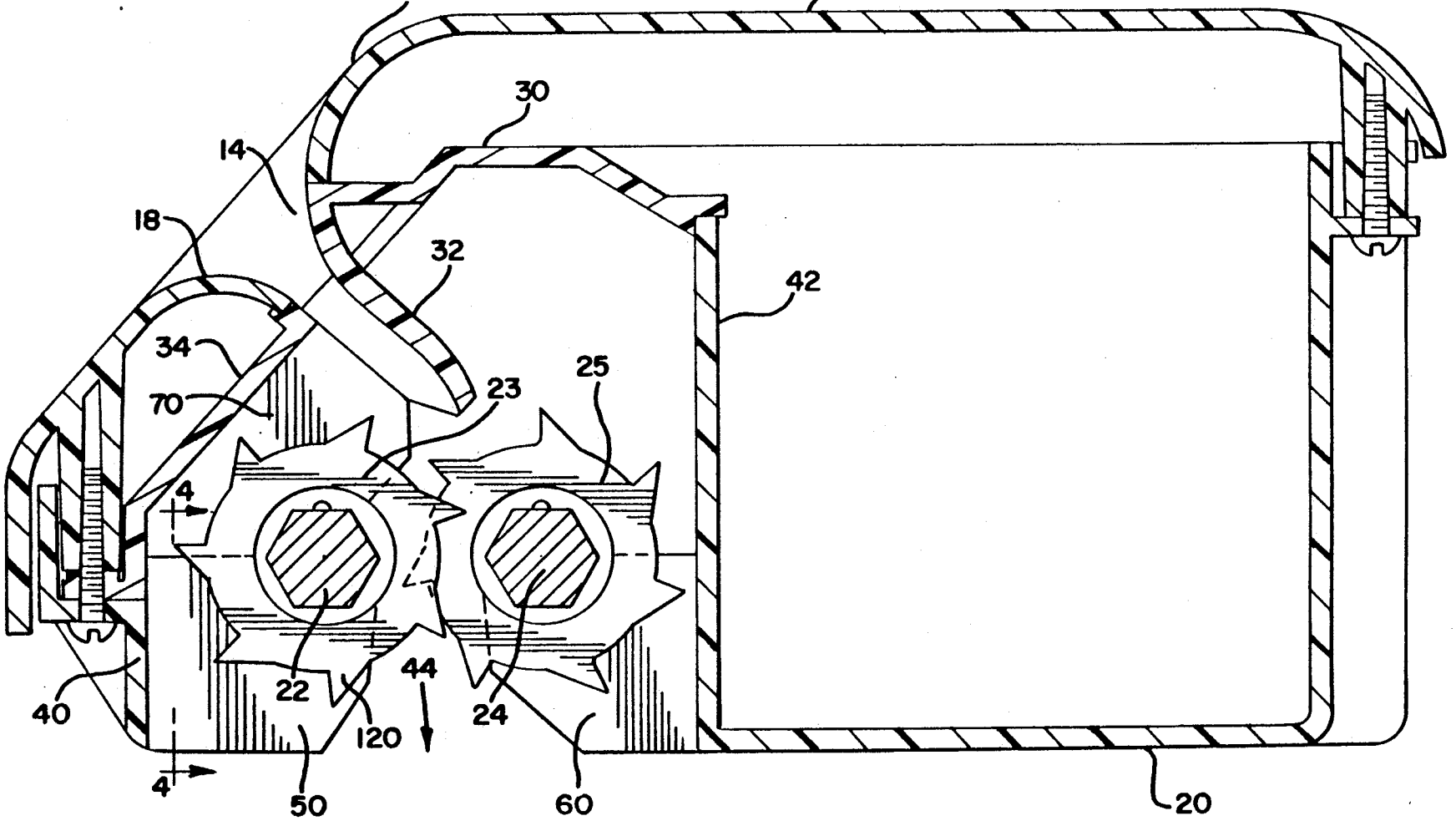
FIG. 2 is a cross section of the paper shredder taken along line 2—2 of FIG. 1.
Figure 5:
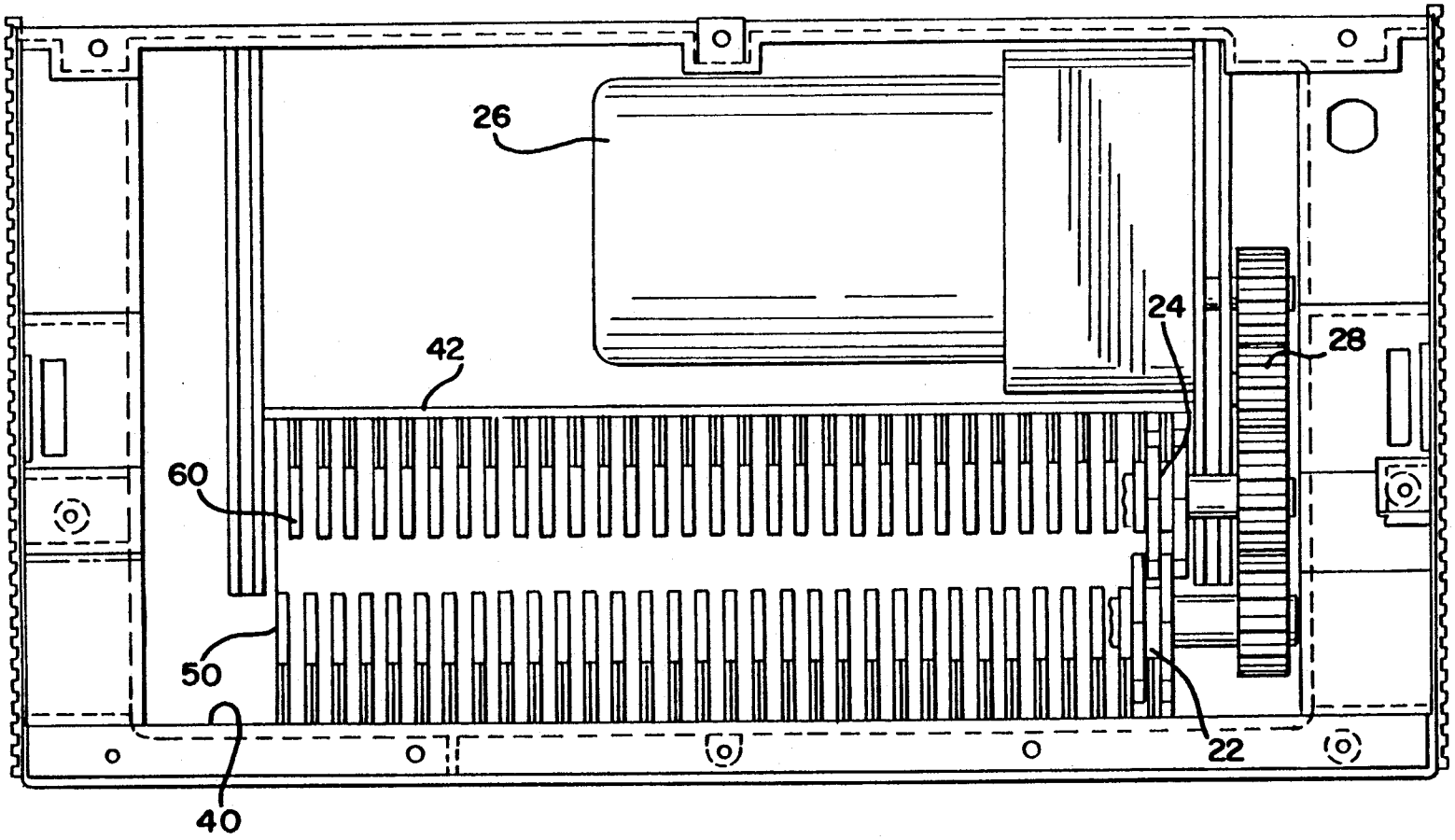
FIG. 5 is a top view of the shredder with the cover removed.

FIG. 2 is a cross-sectional view of the paper shredder 10, with a bottom base 20, a cutting mechanism comprising a cutting cylinder 22 and a cutting cylinder 24, a top housing 30, and a cover 12. The cutting cylinders 22 and 24 are parallel to each other and contain a plurality of spaced apart cutting disks 23 and 25. The cutting cylinders 22 and 24 are arranged relative to each other, so that the cutting disks 23 on the first cylinder 22 interleave with the cutting disks 25 on the second cutting cylinder 24. In addition, as shown in FIG. 5, a motor 26 is provided together with gearing 28 to rotate the cutting cylinders 22 and 24 in opposite directions. Preferably, the motor 26 is able to rotate the cutting cylinders in a forward and, if necessary, a reverse direction.

Figure 3:
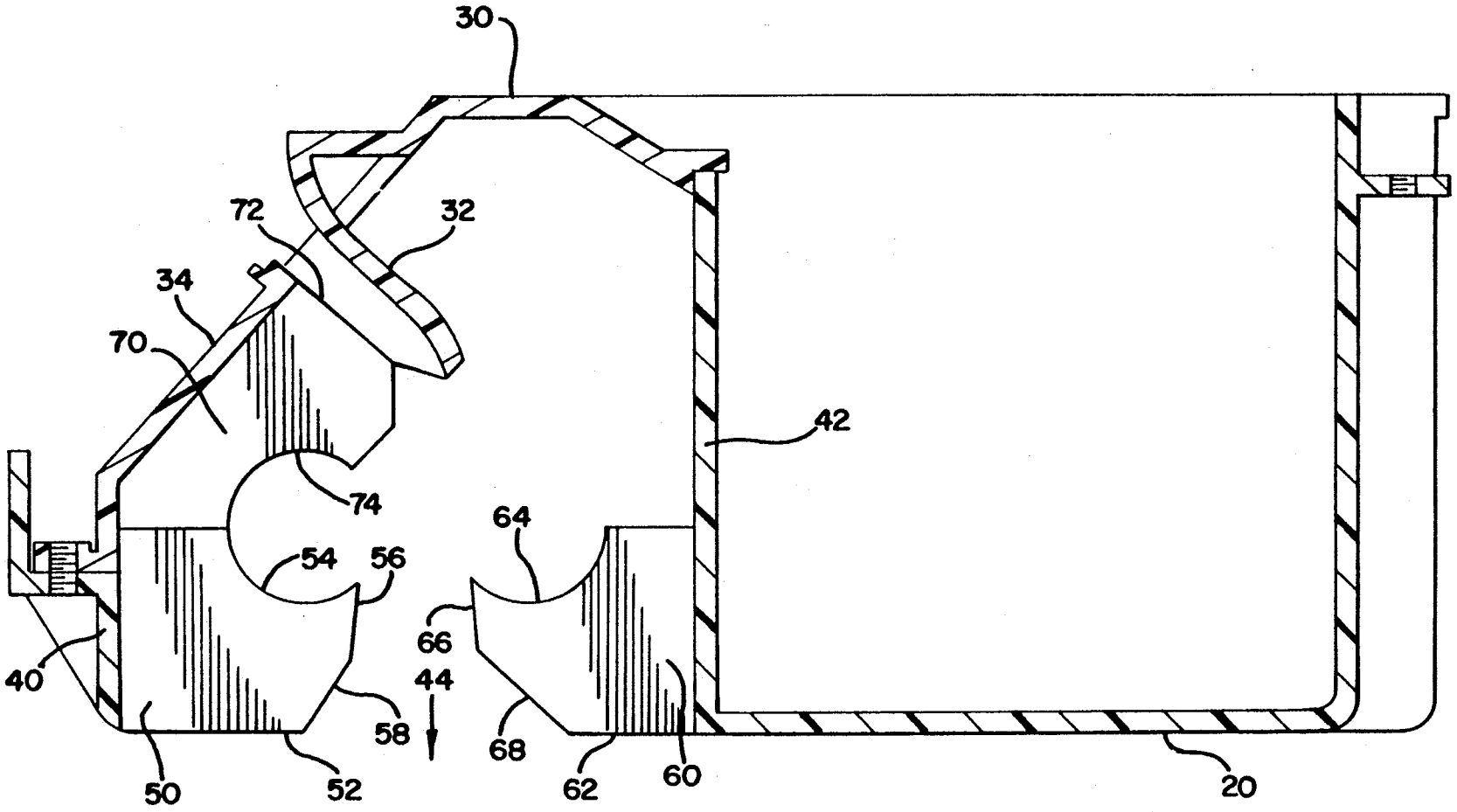
FIG. 3 is a cross section of the paper shredder taken along line 2—2 of FIG. 1 with the cutting mechanism and the cover removed.

Referring now to FIG. 3, there is shown a bottom base 20 having a front wall 40 formed on the base 20 and extending upward. A rear wall 42 formed on the base 20 and extending upward is parallel to and spaced apart from the front wall 40 to define a discharge opening 44 where the shredded paper exits the cutting mechanism.

A plurality of first lower strippers 50 are provided and extend upward and from the front wall 40 toward the discharge opening 44. Preferably, the strippers 50 are integrally formed on the front wall 40 and extend toward the discharge opening 44. The upper portion of the strippers 50 have an arcuate shape 54 which fit in and partially surround the space between the cutting disks 23 located on the first cutting cylinder 22. The lower strippers 50 preferably have a width nearly equal to the width of the space between the disks 23. Also, the arcuate shape 54 preferably is at an angle greater than about 120 degrees. More preferably, the arcuate shape 54 has an angle of about 150 degrees. The strippers 50 also have a base 52 which helps support the paper shredder 10.

In addition, the stripper 50 has a discharge face 56 which will act to guide the stripped or shredded paper downward through the discharge opening 44. Preferably, the discharge face 56 is angled or sloped toward the front wall 40. More preferably, the discharge face 56 is angled toward the front wall 40 at an angle of about 5 degrees.

A plurality of spaced apart second lower strippers 60, may also be provided. When second lower strippers 60 are present, they extend upward and from the rear wall 42 towards the discharge opening 44. Preferably, the strippers 60 are integrally formed on the rear wall 42 and extend toward the discharge opening 44. The lower strippers 60 are located such that they are in an alternating relation to the lower strippers 50 as best seen in FIG. 5. Accordingly, when an individual lower stripper 50 extends toward the discharge opening 44, there is a space between opposite adjacent lower strippers 60.

The upper portion of the lower strippers 60 have an arcuate shape 64. The arcuate shape 64 fits in and partially surrounds the space between the cutting disks 25 on the cutting cylinder 24 to prevent the shredded paper from accumulating in the cutting mechanism. Preferably, the lower strippers 60 have a width nearly equal to the width of the space between the disks 25. Also, the arcuate portion 64 preferably has an angle greater than about 120 degrees. More preferably, the arcuate shape 64 has an angle of about 150 degrees.

The stripper 60 also has a base 62 which helps to support the paper shredder 10. In addition, a discharge face 66 is provided on the portion of the stripper 60 near the discharge opening 44. The discharge face 66 helps to guide the shredded paper downward through the discharge opening 44. Preferably, the discharge face 66 is angled or sloped toward the rear wall 42 to facilitate the removal of the shredded paper from the cutting mechanism. More preferably, the discharge face 66 is sloped at an angle of about 5 degrees.

The strippers 50 and 60 may also have a sloping face 58 and 68, respectively. Where sloping faces are provided, a short sloping face, indicated by 58, alternates with a long sloping face, indicated by 68.

Figure 4:
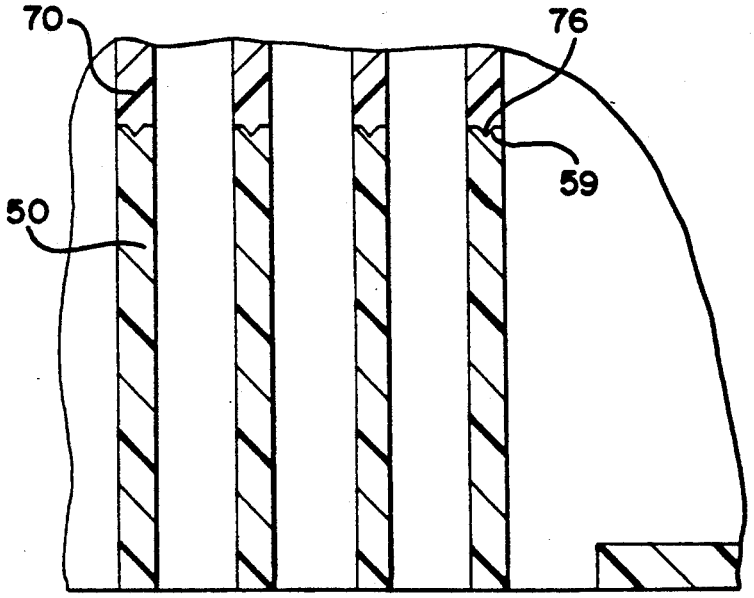
FIG. 4 is a cross section of portion of the paper shredder taken along line 4—4 of FIG. 2.

Optionally, a top housing 30 may be provided. Where a top housing 30 is provided, it will join with the bottom base 20 at the front wall 40 and the rear wall 42. The top housing 30, preferably has a feed guide 32 to guide the paper to be shredded into the cutting mechanism. In addition, the top housing 30 may contain first upper strippers 70 extending from the top housing front wall 34. Preferably, the first upper strippers 70 are integrally formed on the top housing front wall 34 so that they will interact with the first lower strippers 50. Preferably, the first upper strippers have a mating edge 76 which will substantially meet with a mating edge 59 on the lower strippers 50, as best seen in FIG. 4, to align the upper strippers 70 with the lower strippers 50.

The first upper strippers 70 have a feed guide surface 72 which will assist and help to guide the paper to be shredded to the cutting mechanism. The lower portion of the upper strippers 70 have an arcuate shape 74 which will fit in and partially surround the space between the cutting disks 23 on the cutting cylinder 22. Preferably, the width of the upper strippers 70 is nearly the same as the width between the cutting disks 23. Also, the arcuate shape 74 preferably has an angle of at least about 120 degrees. More preferably, the arcuate shape has an angle of about 130 degrees. Accordingly, when the mating edge 76 on the first upper strippers 70 substantially abuts the mating edge 59 on the first lower strippers 50, the arcuate portion 74 and the arcuate portion 54 will substantially surround the space between the cutting disks 23 on the first cutting cylinder 22. Preferably, the arcuate portions 54 and 74 will surround the space between the cutting disks 23 on the cutting cylinder 22 to about 240 degrees. More preferably, the arcuate portions 54 and 74 will surround the space between the cutting disks 23 on the cutting cylinder 22 to about 280 degrees.

Optionally, a plurality of second upper strippers located above the second lower strippers 60 may be provided. Where such strippers are provided, they may be substantially the same as the first upper strippers 70. Accordingly, the lower portion of the second upper stripper will have an arcuate portion to fit in and partially surround the space between the cutting disks 25 on the cutting cylinder 24. Thus, when second upper strippers are provided, its arcuate portion and the arcuate portion 74 of the second lower strippers 60 will substantially surround the space between the cutting disks 25 on the cutting cylinder 24.

The stripper described above can be used with either a cross cut type cutting mechanism, as shown in FIG. 2, or, alternatively, a straight cut type cutting mechanism.

Preferably, the bottom base 20 is integrally formed as one piece from plastic as by, for example, molding. Also, any or all of the front wall 40, the rear wall 42, and the strippers 50 and 60 may be integrally formed from plastic and formed as one piece with the bottom base 20. More, preferably, the bottom base 20 including the front wall 40, the rear wall 42, and the strippers 50 and 60, are all made of plastic and are integrally formed as a single piece.

In addition, the top housing 30 preferably is integrally formed as one piece from plastic as by, for example, molding. Also, either or both of the housing feed guide 32 and the first upper stripper 70 may be integrally formed from plastic and formed as one piece with the top housing 30. More preferably, the top housing 30 is made of plastic with the housing feed guide 32 and the first upper stripper 70 being made of plastic and integrally formed on the top housing 30. Also, the cover 12 is preferably made of plastic with the feed guides 16 and 18 integrally formed as one piece on the cover 12.

As described above, a motor 26 is provided to drive, in opposite directions through a gearing arrangement 28, the cutting cylinders 22 and 24. It will be appreciated that any suitable switch can be used to actuate the motor to turn the gears 28, and thus the cutting cylinders 22 and 24 in either a forward or a reverse direction. Alternatively, an electric eye can be provided in the cover feed opening 14 to automatically activate the motor 26. Of course, other arrangements to actuate the motor can be provided.

Figure 6:
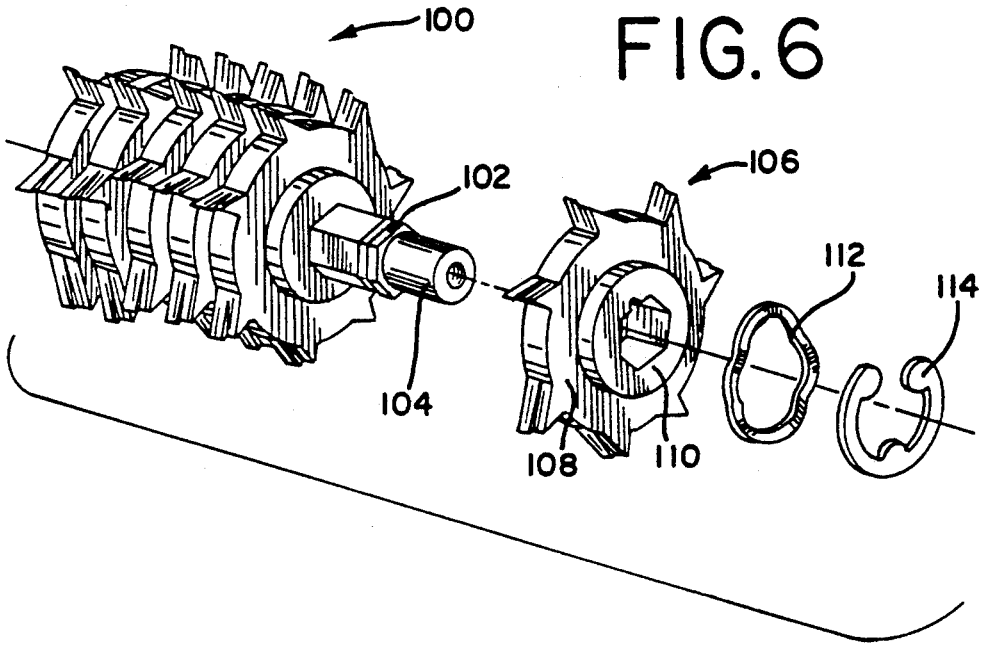
FIG. 6 is an exploded view of a portion of a cutting cylinder of the cutting mechanism.

The present invention also comprises a cross cut type cutting mechanism having a pair of cutting cylinders, one of which is partially shown in FIG. 6 as cutting cylinder 100. Of course, cutting cylinders 22 and 24 shown in FIG. 2 can be the same type as cutting cylinder 100. When cutting cylinders 100 are used in the present invention, the paper to be shredded will be shredded into small chips. Cutting cylinder 100 comprises a hexagonal shaft 102 with a rounded end 104. Although a hexagonal shaft 102 is shown, other shapes may be used.

In one embodiment, shown in FIGS. 6–10, a plurality of cutting disk units 106 comprising a cutting disk 108 and a spacer 110 are provided. Although the cutting disk unit 106 is shown as a single unit, the cutting disk 108 and the spacer 110 may be separate units. When cutting disk 108 and spacer 110 are separate, the spacer 110 will be mounted on the shaft 102 in an alternating fashion with each cutting disk 108. Thus, there will be a spacer 110 between adjacent cutting disks 108. Alternatively, the cutting cylinder 100 may e machined as a single unit. Preferably, however, the cutting disk unit 106 is manufactured as an integral unit. More preferably, the cutting disk unit 106 is manufactured in a sintered metal process.

Preferably, the cutting disk units 106 are stacked onto the cutting shaft 102. A washer 112 and a E-ring 114 can be used to secure the individual cutting disk units 106 onto the shaft 102. Of course, other means well known to those skilled in the art can be used for securing the individual cutting disks 106 onto the shaft 102.

The individual cutting disks 108 have a plurality of teeth 120 protruding outward and inclined forward in the rotation direction of the corresponding cutting cylinder 100. Preferably, when a hexagonal shaft 102 is used, the number of teeth will be such that they meet the formula $6n+1$, where n is greater than 1. Thus, when $n=1$ there will be seven teeth provided about the periphery. In the case of a hexagonal shaft 102, it is preferable to have seven teeth 120.

Figure 7:
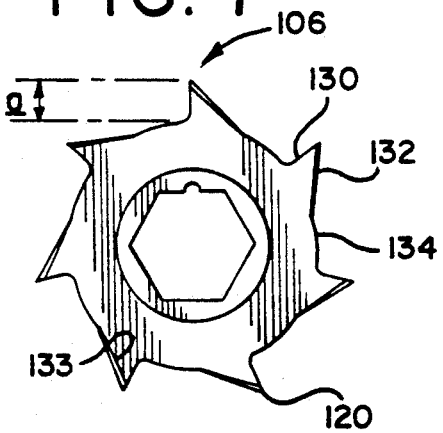
FIG. 7 is a side view of a cutting disk.
Figure 9:
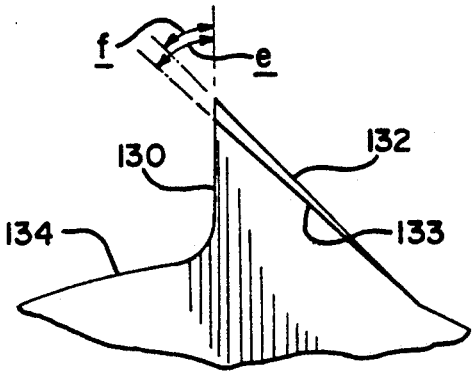
FIG. 9 is an enlarged side view of one of the teeth of a cutting disk.
Figure 10:
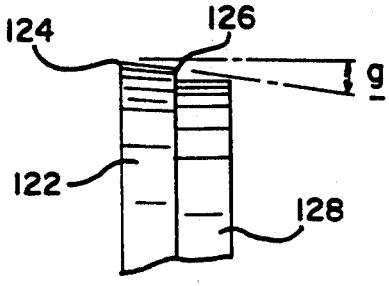
FIG. 10 an enlarged front view of one of the teeth of a cutting disk.

The teeth 120 preferably have a triangular shape, best seen in FIGS. 7 and 9, and comprise a piercing tooth 122 and a flat tooth 128 best seen in FIG. 10. The piercing tooth 122 has a front surface 130 and a rear surface 132 leading to the edge 134 of the cutting disk 108. The flat tooth 128 shares a portion of the front surface 130 with the piercing tooth 122, but has a rear surface 133 leading to the edge 134.

The piercing tooth 122 further has a leading edge 124 and a following edge 126. The piercing tooth 122 slopes or is raked downward from the leading edge 124 to the following edge 126 at an angle shown as g in FIG. 10. Preferably, the slope, g, is about 7 degrees. The leading edge 124 penetrates the paper and the sloping configuration aids in propogating the puncture.

Figure 8:
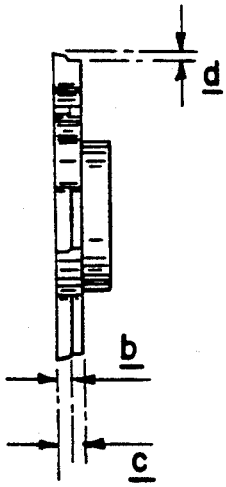
FIG. 8 is a front view of a cutting disk.

The piercing tooth 122 extends above the flat tooth 128 a height d shown in FIG. 8 so that the piercing tooth 122 can effectively puncture the paper to initiate the propagation of the tear. At the same time, the piercing tooth 122 should not extend above the flat tooth 128 an amount such that the piercing tooth 122 becomes subject to fracture upon encountering a foreign object such as, for example, a staple or paper clip. Preferably, the ratio of the height of the piercing tooth 122, measured from the tip of the leading edge 124, to the flat tooth 128 ranges from about 1.1 to about 1.8. More preferably, the ratio is from about 1.3 to about 1.8 and most preferably the ratio is about 1.6.

In addition, the ratio of the width of the piercing tooth 122, shown as b in FIG. 8, to the width of the cutting disk 108, shown as c in FIG. 8, should be in the range of about 0.25 to 0.75. More preferably, the ratio of b to c is about 0.5.

Also, the height of the piercing tooth 122, a, to the width of the cutting disk 108, c, is important for the efficiency of the tooth. The ratio of the height of the piercing tooth, a, to the width of the cutting disk, c, should be at least one, preferably greater than one, and can be as large as practical. More preferably the ratio is up to about 2 and most preferably the ratio is about 1.5.

As described above, the teeth 120 protrude outward and are forwardly inclined from the cutting disk edge 134. Between its front and rear surfaces 130 and 132, the piercing tooth 122 forms a protrusion angle, f, in the range from about 40 to about 50 degrees. More preferably, the protrusion angle, f, is about 45 degrees. Also, between the front and rear surfaces 130 and 133, the flat tooth 128 forms a protrusion angle e which is somewhat greater than the protrusion angle f. Preferably, the protrusion angle e is in the range from about 40 to about 50 degrees. More preferably, the protrusion angle e is about 47 degrees.

The individual cutting disks 108 or their teeth 120 are somewhat reciprocally displaced in the longitudinal direction of the cutting cylinder 100 so that a large pitch helix is formed on the surface. The reciprocal displacement between adjacent disks 108 on the cutting cylinder 100 is a fraction of an inch or a few millimeters or fractions thereof. This helical displacement insures that the engagement of the teeth 120 into the paper to be shredded is gentle and takes place continuously along the longitudinal direction of the cutting cylinder 100. The displacement of the cutting disks 108 or their teeth 120 is oppositely directed on the opposite parallel cutting cylinder.

Alternatively, groups of two or more individual cutting disks 108 or their teeth 120 can be reciprocally displaced in the longitudinal direction of he cutting cylinder 100. For example, as shown in FIG. 6, a group of four individual cutting disks 108 are reciprocally displaced from the adjacent group of four individual cutting disks 108. The reciprocal displacement between the adjacent groups of individual disks 108 is a fraction of an inch or a few millimeters or fractions thereof. Preferably, a group consisting of two individual disks 108 is used.

The meshing relationship between the cutting disks on the opposite cutting cylinders can best be seen in FIG. 2. As shown in FIG. 2, the teeth 120 on the first cutting cylinder 22 will overlap with the edge 134 on the cutting disk on the cutting cylinder 24. In this way, the teeth 120 on the cutting cylinder 22 will alternately engage in the paper with the teeth 120 on the cutting cylinder 24. This meshing arrangement is important to obtain the cross-cutting action to produce the confetti or small chips instead of kinked strips which can be produced when the proper meshing arrangement is not maintained.

Of course, it should be understood that a wide range of changes and modifications can be made to the preferred embodiment described above. It is therefore intended that the foregoing description illustrates rather than limits this invention, and that it is the following claims, including all equivalents, which define this invention.

We claim:

1. A shredding machine comprising:

a. a bottom base having a front wall extending upward and rear wall extending upward parallel to and spaced from the front wall, the space between the front wall and the rear wall defining a discharge opening;

b. a cutting mechanism comprising two parallel cutting cylinders, each cylinder having a plurality of spaced apart cutting disk with the cutting disks of the first cutting cylinder interleaved with the cutting disks of the second cutting cylinder; and, c. a plurality of spaced apart lower strippers integrally formed on and extending from the front wall, a portion of the top of the strippers being arcuately shaped at angle greater than about 120 degrees to fit in and partially surround the rear and lower portion of the space between the cutting disks on the first cutting cylinder, the strippers further having a width substantially the same as the width of the space between adjacent cutting disks on the first cutting cylinder with a lower portion of the strippers comprising a base that extends toward the discharge opening and lies in the same plane as the bottom base to further support the shredding machine.

2. The shredding machine of claim 1 wherein the top portion of the strippers is arcuately shaped with an angle of about 150 degrees to partially surround the rear and the lower portion of the space between the cutting disks on the first cutting cylinder.

3. The shredding machine of claim 1 wherein at least some of the strippers further have a discharge face adjacent the discharge opening.

4. The shredding machine of claim 3 wherein the discharge face is sloped toward the front wall at an angle of about 5 degrees.

5. The shredding machine of claim 3 further comprising a second plurality of spaced apart lower strippers integrally formed on and extending from the rear wall, a portion of the top of the strippers being arcuately shaped at an angle greater than about 120 degrees to partially surround the rear and lower portion of the space between the cutting disks on the second cutting cylinder.

6. The shredding machine of claim 5 wherein the top portion of the lower strippers is arcuately shaped with an angle of about 150 degrees to partially surround the rear and the lower portion of the space between the cutting disks on the second cutting cylinder.

7. The shredding machine of claim 5 wherein the lower portion of the strippers comprise a base extending toward the discharge opening and lying in the same plane as the bottom base to further support the shredder.

8. The shredding machine of claim 5 wherein at least some of the strippers further have a discharge face adjacent the discharge opening.

9. The shredding machine of claim 8 wherein the discharge face is sloped toward the rear wall at an angle of about 5 degrees.

10. The shredding machine of claim 5 further comprising:

a. a top housing with a front wall; and, b. a plurality of spaced apart upper strippers integrally formed on and extending from the front wall, a portion of the bottom of the strippers being arcuately shaped at an angle of at least about 120 degrees such that when the top housing is joined to the bottom base the upper strippers substantially abut the lower strippers to substantially surround the space between the disks on the first cutting cylinder.

11. A shredding machine comprising:

a. a top housing with a front wall;

b. a bottom base having a front wall extending upward and rear wall extending upward parallel to and spaced from the front wall, the space between the front wall and the rear wall defining a discharge opening;

c. a cutting mechanism comprising two parallel cutting cylinders, each cylinder having a plurality of spaced apart cutting disks with the cutting disks of the first cutting cylinder interleaved with the cutting disks of the second cutting cylinder;

d. a plurality of spaced apart lower strippers integrally formed on and extending from the front wall, a portion of the top of the strippers being arcuately shaped at angle greater than about 120 degrees to partially surround the rear and lower portion of the space between the cutting disks on the first cutting cylinder, the strippers further having a width substantially the same as the width of the space between adjacent cutting disks on the first cutting cylinder; and, e. a plurality of spaced apart upper strippers integrally formed on and extending from the front wall, a portion of the bottom of the strippers being arcuately shaped at an angle of at least about 120 degrees such that when the top housing is joined to the bottom base the upper strippers substantially abut the lower strippers to substantially surround the space between the disks on the first cutting cylinder.

12. The shredding machine of claim 11 wherein the top portion of the upper strippers have a feed guide surface to guide material to the cutting mechanism to be shredded.

13. A shredding machine comprising:

a. a top housing with a front wall;

b. a bottom base;

c. a bottom front wall integrally formed on and extending upward from the bottom base;

d. a rear wall integrally formed on and extending upward parallel to and spaced from the front wall, the space between the front wall and the rear wall defining a discharge opening;

e. two parallel cutting cylinders, each cylinder having a plurality of spaced apart cutting disks with the cutting disks of the first cutting cylinder interleaved with the cutting disks of the second cutting cylinder;

f. a plurality of spaced part first lower strippers integrally formed on and extending from the front wall, a portion of the top of the strippers being arcuately shaped at angle greater than about 120 degrees to partially surround the rear and lower portion of the space between the space between the cutting disks on the first cutting cylinder;

g. a plurality of spaced part second lower strippers integrally formed on and extending from the rear wall, a portion of the top of the strippers being arcuately shaped at an angle greater than about 120 degrees to partially surround the rear and lower of the space between the cutting disks on the second cutting cylinder; and, h. a plurality of spaced apart upper strippers integrally formed on and extending from the top housing front wall, a portion of the bottom of the strippers being arcuately shaped at an angle of at least about 120 degrees such that when the top housing is joined to the bottom base the upper strippers substantially abut the lower strippers to substantially surround the space between the disks on the first cutting cylinder.

* * * * *

UNITED STATES PATENT AND TRADEMARK OFFICE

CERTIFICATE OF CORRECTION

PATENT NO. : 5,295,633
DATED : March 22, 1994
INVENTOR(S) : C. David Kimbro et al.

It is certified that error appears in the above-indentified patent and that said Letters Patent is hereby corrected as shown below:

IN THE TITLE PAGE

In column 2, after "Attorney, Agent, or Firm-" delete "Wilian" and substitute --Willian--.

In column 2, line 3, delete "in" and substitute --is--.

In column 2, line 10, after "are" insert --formed in a semi---.

In column 3, line 32, after "10" insert --is--.

In column 6, line 23, delete "e" and substitute --be--.

UNITED STATES PATENT AND TRADEMARK OFFICE

CERTIFICATE OF CORRECTION

PATENT NO. : 5,295,633
DATED : March 22, 1994
INVENTOR(S) : C. David Kimbro et al.

It is certified that error appears in the above-indentified patent and that said Letters Patent is hereby corrected as shown below:

IN THE CLAIMS

In Claim 1, line 9, delete "disk" and substitute --disks--.

In Claim 5, line 1, delete "3" and substitute --1--.

In Claim 13, line 15, delete "part" and substitute --apart--.

Signed and Sealed this

Eighteenth Day of October, 1994

*Attest:*

*Attesting Officer*

BRUCE LEHMAN

*Commissioner of Patents and Trademarks*